United States Patent [19]

de Vaujany

[11] Patent Number: 5,048,706

[45] Date of Patent: Sep. 17, 1991

[54] MEANS FOR TAMPERPROOF SEALING OF A CONTAINER

[75] Inventor: Robert de Vaujany, Genas, France

[73] Assignee: Manufacture Lyonnaise de Bouchage, Lyons, France

[21] Appl. No.: 401,248

[22] Filed: Aug. 31, 1989

[30] Foreign Application Priority Data

Sep. 9, 1988 [FR] France ..... 88 12060

[51] Int. Cl.[5] ..... B65D 41/48

[52] U.S. Cl. ..... 215/251; 215/254

[58] Field of Search ..... 215/249, 254, 251, 255; 210/270

[56] References Cited

U.S. PATENT DOCUMENTS

| | | | |
|---|---|---|---|
| 3,067,898 | 12/1962 | Reimann | 215/249 |
| 4,251,003 | 2/1981 | Bodenmann . | |
| 4,456,138 | 6/1984 | Bereziat . | |
| 4,534,481 | 8/1985 | Summers et al. | 215/255 X |
| 4,733,787 | 3/1988 | Knopf et al. | 220/270 |

FOREIGN PATENT DOCUMENTS

| | | | |
|---|---|---|---|
| 2432444 | 6/1975 | Fed. Rep. of Germany | 215/251 |
| 2854834 | 7/1980 | Fed. Rep. of Germany . | |
| 2086314 | 12/1971 | France . | |
| 2529531 | 1/1984 | France . | |

*Primary Examiner*—Stephen Marcus

*Attorney, Agent, or Firm*—Oliff & Berridge

[57] ABSTRACT

A cap is composed of a cylindrical skirt provided with a central opening, and ensures the locking of a plug in the opening of a neck of a container. A tear-off lid is sealed onto this cap and, by means of a projecting part on a gripping ring of the cap, is connected by a strip to a portion of the upper end of the skirt delimited circumferentially by tear-off lines parallel to the generatrices of the skirt, extending over the entire height of the latter and associated with partial cuts. The skirt tears off when the lid is torn off by means of the ring. The cap is particularly useful for sealing of containers for sterile non-injectable pharmaceutical products.

18 Claims, 2 Drawing Sheets

MEANS FOR TAMPERPROOF SEALING OF A CONTAINER

TECHNICAL FIELD

The present invention relates to means for tamperproof sealing a container of the type comprising a cap composed of a cylindrical skirt or sleeve, provided with a central opening, ensuring the locking of a plug in the opening of the container. A tear-off inner lid of aluminum sheet or the like is fastened to the cap by bonding or welding. The lid is dimensioned to project beyond the cap to which it is fastened, and its projecting part, in other words, its entire periphery, is made integral by bonding, sealing, or other means, with a fitted rigid gripping ring engaging the cap at least partially.

BACKGROUND

Such means have been described in French Patent 2,529,531. This type of seal can be used on certain containers containing, for example, sterile liquid pharmaceutical products for injection. The plug is a tight stopper made of flexible material forced into the opening in the neck of the container and capable of being traversed by the needle of a syringe to remove the product. The cap locking this plug is provided with a notch fitted elastically beneath a shoulder on the neck of the container and with a central opening permitting passage of the needle, and is sealed before use by a tear-off lid attached to it by bonding, heat sealing, or other means and making it possible completely to isolate the plug from external contaminants and thus guarantee the stability of the product contained in the container. This lid is likewise attached to a rigid gripping ring connected to the cap by strips of material and permitting tearing off of the lid in a reliable, easy, and practical fashion using one hand, in order to provide access to the plug via the central opening.

This design, while it does apply to injectables, is not suitable for other sterile pharmaceutical products, for example, powders, for which it is necessary to remove the locking cap completely in order to be able to remove the plug and gain access to the product inside.

SUMMARY OF THE INVENTION

An object of the present invention is therefore to provide means for sealing which ensure perfect tightness while permitting reliable and easy tearing off of the locking cap, which must be able to be performed rapidly and practically with one hand, and to routinely yield satisfactory results.

This and other objects are achieved by the present invention, in which a rigid gripping ring is connected by a strip of material to a portion of the upper end of the cylindrical skirt of the cap, in the vicinity of at least one tear-off line extending for the entire height of the cylindrical skirt and being associated with a partial cut made in the outside wall of the cap and extending from the tear-off line as far as the central opening of the cap, so that this skirt tears off along the tear-off line following a pull on the pull-off lid using the rigid gripping ring.

This easy manipulation of the ring simultaneously results in tearing off the lid and tearing open the cap for the entire height of the skirt. It is therefore sufficient to pull on it in order to have access to the plug.

DETAILED DESCRIPTION OF PREFERRED EMBODIMENTS

Figure 1:
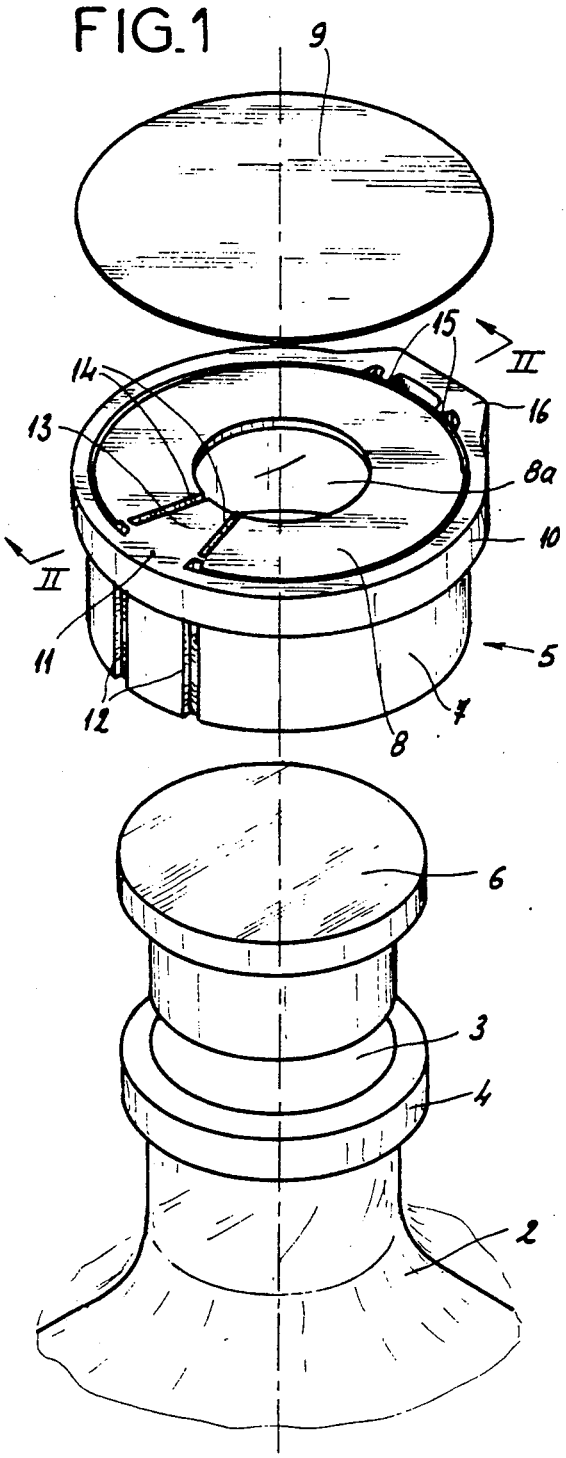
FIG. 1 is an exploded view of an embodiment of the invention in perspective.

In the sealing means of the invention, the lid has the advantage of protecting the visible part of the rubber plug against all forms of contamination, whether liquid or in dust form. This lid also has the additional advantage of being able to serve to carry any information relating to the product packaged in the container, especially to identify it or to provide any other information.

According to a preferred embodiment of the invention, the strip of material linking the rigid gripping ring to the cylindrical skirt is delimited circumferentially by the two upper ends of two tear-off lines parallel to the generatrices of the cylindrical skirt.

Preferably, the strip of material is extended as far as the central opening of the cap by a tab defined by two partial cuts made in the wall of the outside of the cap, each of which lies in the diametral plane of a tear-off line.

According to a useful provision of the invention, the rigid gripping ring is provided in the area essentially diametrally opposite the strip of material, with a prong extending toward the exterior which can facilitate the manipulation of the ring.

To prevent accidental tearing of the gripping ring, it may be connected to the cap by at least one arm of material, preferably two, designed as breakaway tabs which are easy to break. Such an arm or arms of material may advantageously be located at the prong of the gripping ring.

To reinforce the tamperproof nature of the inventive sealing means, the cap is made of a thermoplastic material such as polypropylene, which can split when an attempt is made to open the container by means other than the gripping ring.

The attached schematic diagrams show, as a nonlimitative example, one embodiment of the inventive sealing means in the case when it is applied to sealing a container for a sterile pharmaceutical product.

The container in the assembly shown in the drawings is a vial of which only the neck 2 is visible. Near its upper end which surrounds the opening 3 of the vial, neck 2 has an external shoulder 4 which is provided to ensure attachment by elastic engagement of a cap 5 made of thermoplastic material, preferably polypropylene or the like. The cap 5 provides the locking for a plug 6 made of a natural or synthetic material.

Cap 5 is composed of a cylindrical sleeve or skirt 7 provided with a central opening 8*a* in its end wall 8.

Figure 2:
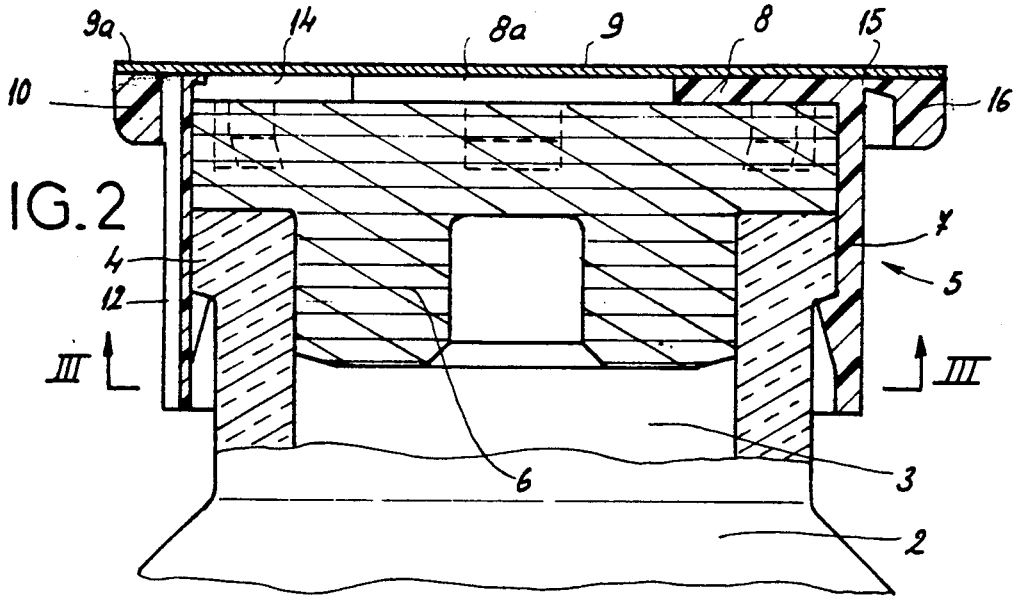
FIG. 2 is a section along line II—II in FIG. 1.

A tear-off lid 9, which may be made of aluminum sheet, covers central opening 8*a* of cylindrical sleeve or skirt 7 to protect lid 6 against the entry of dust or other impurities. In the example shown in the drawings, and as emerges from FIG. 2 in particular, tear-off lid 9 may be attached by heat sealing to the end wall 8 of sleeve 7. Part 9*a*, which projects relative to cylindrical skirt 7, may be assembled in the same way to a rigid gripping ring 10 fitted to cap 5. As shown in FIG. 2, the top surface of the gripping ring 10 can be substantially coplanar with the substantially planar top surface of end wall 8.

Rigid gripping ring 10 is connected by a strip of material 11 to a portion of the upper end of cylindrical skirt 7 circumferentially delimited by the two upper ends of two tear-off lines 12 parallel to the generatrices of cylindrical skirt 7 and extending over the entire height of the latter. In this embodiment, there are two grooves 12 along which cylindrical skirt 7 has less thickness and is hence more fragile. The pull exerted by means of strip 11 with the aid of rigid gripping ring 10 is therefore sufficient to tear off the cap along these two lines 12.

Strip 11 may be extended as far as central opening 8*a* of cap 5 by a tab 13 defined by two partial cuts 14 made in the end wall 8 of cap 5. Each cut 14 lies in the diametral plane of a tear-off line 12.

In the vicinity of cap 5, diametrally opposite tab 13, rigid gripping ring 10 may be connected to end wall 8 by means of two arms of material designed as breakaway tabs or arms 15 that are easy to break. At these arms 15, rigid gripping ring 10 has a prong 16 projecting toward the exterior and provided to facilitate its manipulation.

Figure 4:
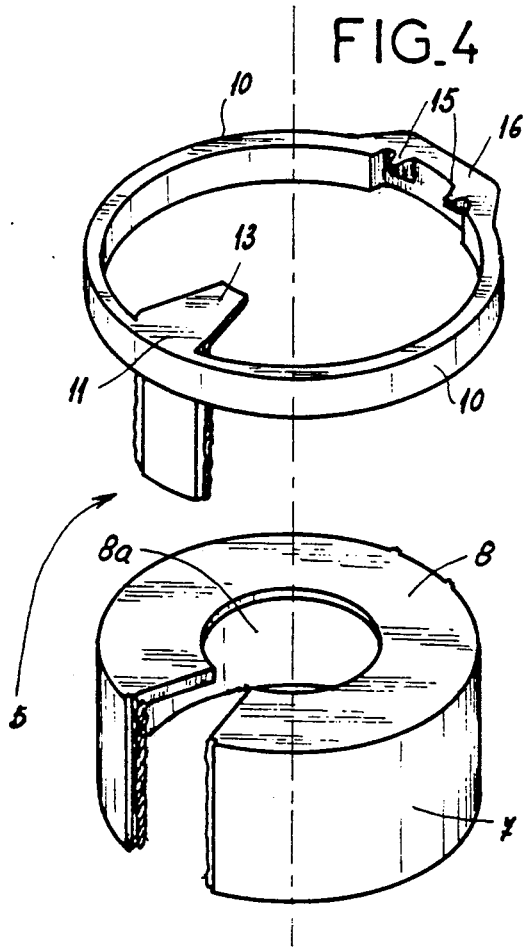
FIG. 4 is an exploded perspective view showing the rigid ring without the tear-off lid and the cylindrical skirt of the cap after being torn off.

In use, cap 5 may be torn off as follows:

The user applies the end of his thumb below prong 16 and pushes upward to break the two breakaway arms 15. It is then merely necessary to pull on ring 10 to remove tear-off lid 9 from end wall 8 and to tear off the part of cylindrical skirt 7 located between its two tear-off lines 12. Ring 10 is then completely separated from cap 5, which then makes it easy to remove cap 5 from neck 2 of the container by virtue of its elasticity. FIG. 4 shows this situation exactly.

Plug 6 is no longer locked by cap 5 and the user can remove it to gain access to the preserved sterile product as such inside the container.

It is clear that tamperproof sealing means according to the invention permits easy removal of lid 9 and tearing of cap 5 while ensuring perfect tightness of the container.

Figure 3:
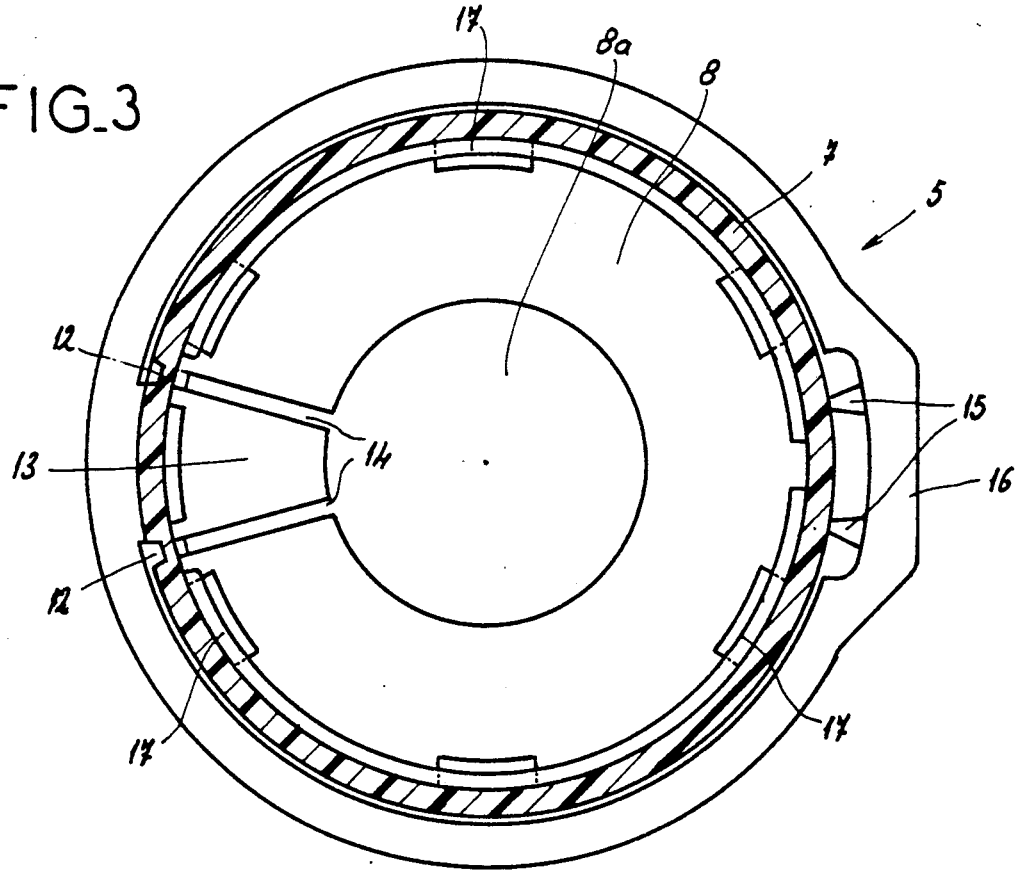
FIG. 3 is a cross section along line III—III in FIG. 2, with the neck of the container and the plug not shown.

In order to shorten the capping time of containers using this sealing means, the cap may be provided with stops 17 for positioning plug 6 in the opening in neck 2 of the container. As FIG. 3 particularly shows, these stops 17 are uniformly distributed around the upper end of the inside wall of cylindrical skirt 7. They make it possible to lock or hold elastic plug 6 relative to the cap and thus to cause these two elements to engage neck 2 of the container when it is sealed.

It goes without saying and follows from the above that the invention is not limited to the sole embodiment of this sealing means described above as a nonlimitative example; on the contrary, it embraces all versions.

Thus, for example, cylindrical skirt 7 can have only a single tear-off line 12 associated with a partial cut 14 in end wall 8, or ring 10 could be not connected by one or more breakaway tabs 15 to cap 5, or the latter could not comprise any stops for positioning plug 6.

WHAT IS CLAIMED IS:

1. A cap for a container, comprising:

a hollow skirt having at least one tear-off line extending over a height of said skirt, said skirt having an upper surface;

a rigid gripping ring surrounding the skirt and connected by at least one strip of material to an upper end position of said skirt in a vicinity of said at least one tear-off line, said gripping ring having an upper surface substantially coplanar with said skirt upper surface; and a tear-off lid attached to said skirt and to said gripping ring;

whereby said skirt and said tear-off lid may be removed from a container by pulling said gripping ring.

2. A cap according to claim 1, wherein said skirt has an upper end wall extending in a plane perpendicular to an axis of said skirt, and said upper end wall of said skirt includes a central opening.

3. A cap according to claim 2, wherein the tear-off lid is attached to said upper end wall of said skirt.

4. A cap according to claim 3, wherein an entire periphery of said tear-off lid is made integral with said gripping ring.

5. A cap according to claim 4, wherein said entire periphery of said tear-off lid is made integral with said gripping means by adhesive bonding or welding.

6. A cap according to claim 3, wherein said tear-off lid is attached to said upper end wall of said skirt by adhesive bonding or welding.

7. A cap according to claim 3, wherein said tear-off lid is made of aluminum.

8. A cap according to claim 2, wherein said end wall includes at least one partial cut in the vicinity of an upper end of said at least one tear-off line.

9. A cap according to claim 8, wherein said at least one partial cut extends from adjacent an upper end of said at least one tear-off line to said central opening.

10. A cap according to claim 9, wherein said strip of material extends as far as said central opening of said upper end wall to form a tab defined by two said partial cuts, each of said partial cuts being located in a diametral plane of said tear-off line.

11. A cap according to claim 1, wherein the skirt is of a shape formed by a generatrice and said strip of material is delimited circumferentially by two upper ends of two said tear-off lines, said tear-off lines being parallel to the generatrice of said skirt.

12. A cap according to claim 1, wherein said gripping ring is provided in an area essentially diametrally opposite said strip with a prong extending outwardly and serving to facilitate manipulation of said gripping ring.

13. A cap according to claim 1, wherein said gripping ring is connected to said skirt at an area remote from said strip by at least one breakaway tab.

14. A cap according to claim 13, wherein said gripping ring includes a prong extending outwardly from said gripping ring in an area essentially diametrally opposite said strip and serving to facilitate manipulation of said gripping ring, and two said breakaway tabs connect said gripping ring to said skirt at said prong.

15. A cap according to claim 1, further comprising positioning stops disposed on an inside wall of said skirt and permitting attachment of a plug to said cap for engagement of said plug and said skirt on a neck of the container when it is sealed.

16. A cap according to claim 1, wherein said cap is made of a thermoplastic material which can split if an attempt is made to open the container using means other than the gripping ring.

17. A cap according to claim 16, wherein said thermo-plastic material is polypropylene.

18. A cap as in claim 1, wherein the skirt is cylindrical.

* * * * *